US008347803B2

(12) United States Patent
Lee et al.

(10) Patent No.: US 8,347,803 B2
(45) Date of Patent: Jan. 8, 2013

(54) ROLL SUPPRESSION DEVICE FOR OFFSHORE STRUCTURE

(75) Inventors: Jung Han Lee, Geoje-si (KR); Yong Soo Kim, Geoje-si (KR); Je Hyouk Woo, Seoul (KR); Dae Woong Kim, Geoje-si (KR); Sung Gun Park, Geoje-si (KR); Jong Ou Nahm, Geoje-si (KR); Byeong Won Park, Geoje-si (KR)

(73) Assignee: Daewoo Shipbuilding & Marine Engineering Co., Ltd. (KR)

( * ) Notice: Subject to any disclaimer, the term of this patent is extended or adjusted under 35 U.S.C. 154(b) by 0 days.

(21) Appl. No.: 12/722,712

(22) Filed: Mar. 12, 2010

(65) Prior Publication Data

US 2011/0061578 A1 Mar. 17, 2011

(30) Foreign Application Priority Data

Sep. 15, 2009 (KR) ..... 10-2009-0086849

(51) Int. Cl.
*B63B 39/06* (2006.01)

(52) U.S. Cl. ..... 114/126

(58) Field of Classification Search ..... 114/122, 114/126

See application file for complete search history.

(56) References Cited

U.S. PATENT DOCUMENTS

| | | | | |
|---|---|---|---|---|
| 646,331 | A * | 3/1900 | Turc | 114/59 |
| 1,100,739 | A * | 6/1914 | Ipacs | 114/348 |
| 3,397,545 | A * | 8/1968 | Leavitt | 405/208 |
| 4,182,255 | A * | 1/1980 | Reid | 114/126 |
| 4,266,496 | A * | 5/1981 | Carlsen | 114/126 |
| 6,487,982 | B2 * | 12/2002 | Takahashi et al. | 114/121 |
| 6,712,560 | B1 * | 3/2004 | Cottrell | 405/224.4 |
| 7,677,838 | B2 * | 3/2010 | Matsuura et al. | 405/212 |
| 2007/0272143 | A1 * | 11/2007 | Koop et al. | 114/122 |

* cited by examiner

*Primary Examiner* — Stephen Avila
(74) *Attorney, Agent, or Firm* — Seed IP Law Group PLLC

(57) ABSTRACT

The present disclosure relates to a roll-suppression device for an offshore structure. The device includes a damping plate separated downward from a hull to be placed below a bottom of the offshore structure by a connection unit, so that the width of the damping plate may be effectively enlarged without occurrence of collision during shuttle docking or ship-to-ship operation. Accordingly, the device may maximize roll-suppression, as compared with a bilge-keel or a step, and a detachable design of the device facilitates ship construction or shore operation inside a drydock.

11 Claims, 3 Drawing Sheets

ROLL SUPPRESSION DEVICE FOR OFFSHORE STRUCTURE

BACKGROUND

1. Technical Field

The present disclosure relates to a roll-suppression device for an offshore structure and, more particularly, to a roll-suppression device for an offshore structure that enables enlargement of a width of a damping plate for suppressing roll of the offshore structure in order to maximize the effect of suppressing the roll and is configured to eliminate a risk of collision of the damping plate having the enlarged width with other ships during shuttle docking or ship-to-ship operation. Further, this device has a detachable structure so as to enable a building operation within a dock or a outfitting operation at shore.

2. Description of the Related Art

In general, an offshore structure is shaped like a ship or a barge, such as floating production storage offloading (FPSO), liquefied natural gas floating production storage offloading (LNG FPSO), floating storage and re-gasification unit (FSRU), etc., which moves in various directions by wind, seawater flow or the like. Among such motions of the offshore structure, rolling has a much smaller damping coefficient than motion in other directions such as pitching, yawing or the like, thereby causing a large rolling motion even on a benign sea.

For the sake of stability and working efficiency on the sea, the offshore structure has generally used a bilge-keel to reduce rolling.

The bilge-keel for reducing rolling, wherein a ship or the like rocks from side to side, is longitudinally attached to left and right bilge strakes, starboards and/or ports of a hull, where the bottom and lateral walls of the hull meet, in a longitudinal direction of the hull. A conventional offshore structure employs the bilge-keel to reduce rolling, but the bilge-keel is not particularly effective at reducing rolling, since it cannot be designed beyond the bilge radius, lateral side and bottom of the offshore structure due to various risks.

In addition, not only do devices for actively suppressing roll of the offshore structure, i.e., an anti-roll tank, a fin stabilizer, etc. have a complicated structure, but also there is no example of practical application to the offshore structure due to issues in maintenance, effect, etc. Moreover, a step, a skirt and the like are considered in light of a large bilge-keel, but entail a serious risk during shuttle docking or ship-to-ship offloading, since they are directly mounted to a base line.

BRIEF SUMMARY

The present disclosure is directed to solving the problems as described above, and one embodiment provides a roll-suppression device that efficiently reduces roll due to large waves applied to an offshore structure, improves stability and work efficiency of the offshore structure at sea, and removes risks during shuttle docking or ship-to-ship operation.

In accordance with one embodiment, a roll-suppression device for an offshore structure includes: a connection unit protruding downward from a bottom of the offshore structure; and a damping plate connected to the connection unit and separated from the bottom of the offshore structure to suppress rolling of the offshore structure.

The damping plate may be connected to the connection unit at either side of the bottom of the offshore structure to be disposed along either side of the bottom.

The damping plate may be disposed to face an outside of the offshore structure while intersecting a lower end of the connection unit at a right angle.

The roll-suppression device may further include a reinforcement member secured to the damping plate and the connection unit to reinforce the damping plate. The roll-suppression device may be detachably connected to the connection unit.

DETAILED DESCRIPTION

Exemplary embodiments of the present disclosure will be now described in detail with reference to the accompanying drawings. The following embodiments are given by way of illustration to provide a thorough understanding of the invention to those skilled in the art. Hence, it should be understood that other embodiments will be evident based on the present disclosure, and that system, process or mechanical changes may be made without departing from the scope of the present disclosure.

Figure 1:
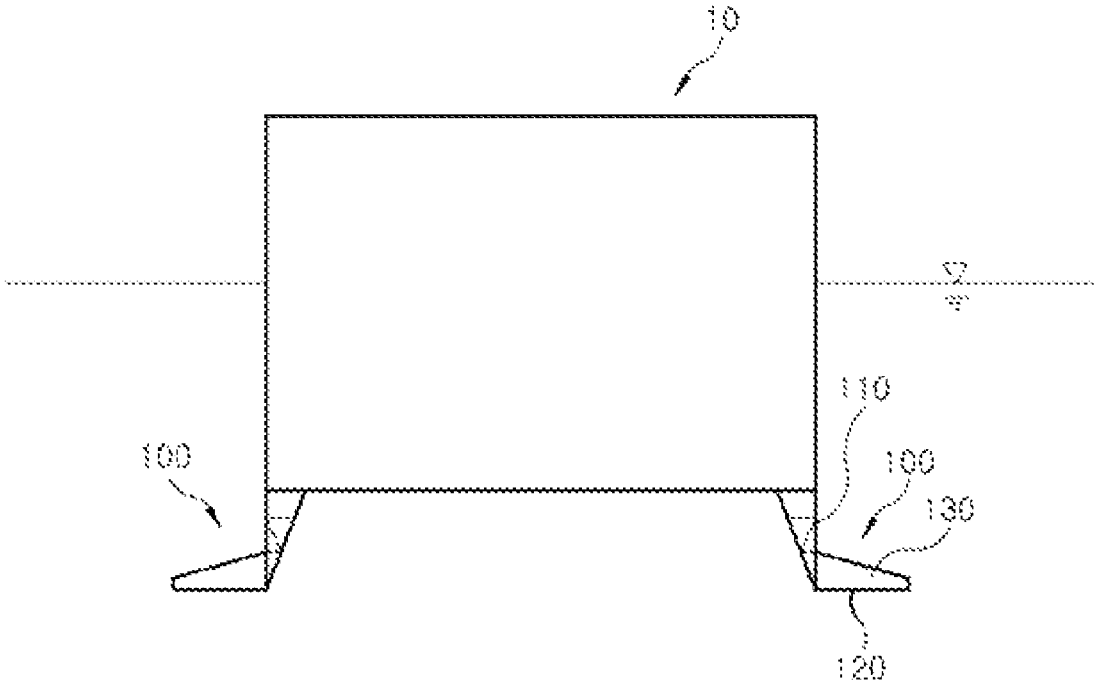
FIG. 1 is a front view of a roll-suppression device for an offshore structure in accordance with one exemplary embodiment of the present disclosure.
Figure 2:
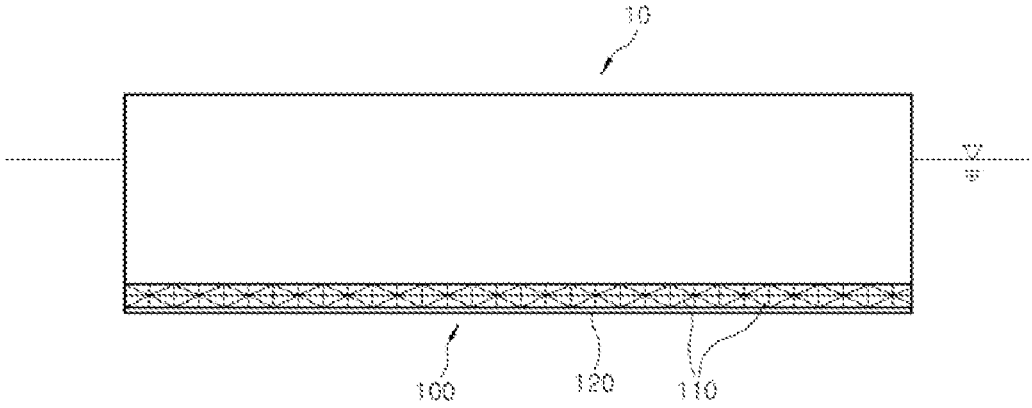
FIG. 2 is a side view of the roll-suppression device in accordance with the exemplary embodiment of the present disclosure.
Figure 3:
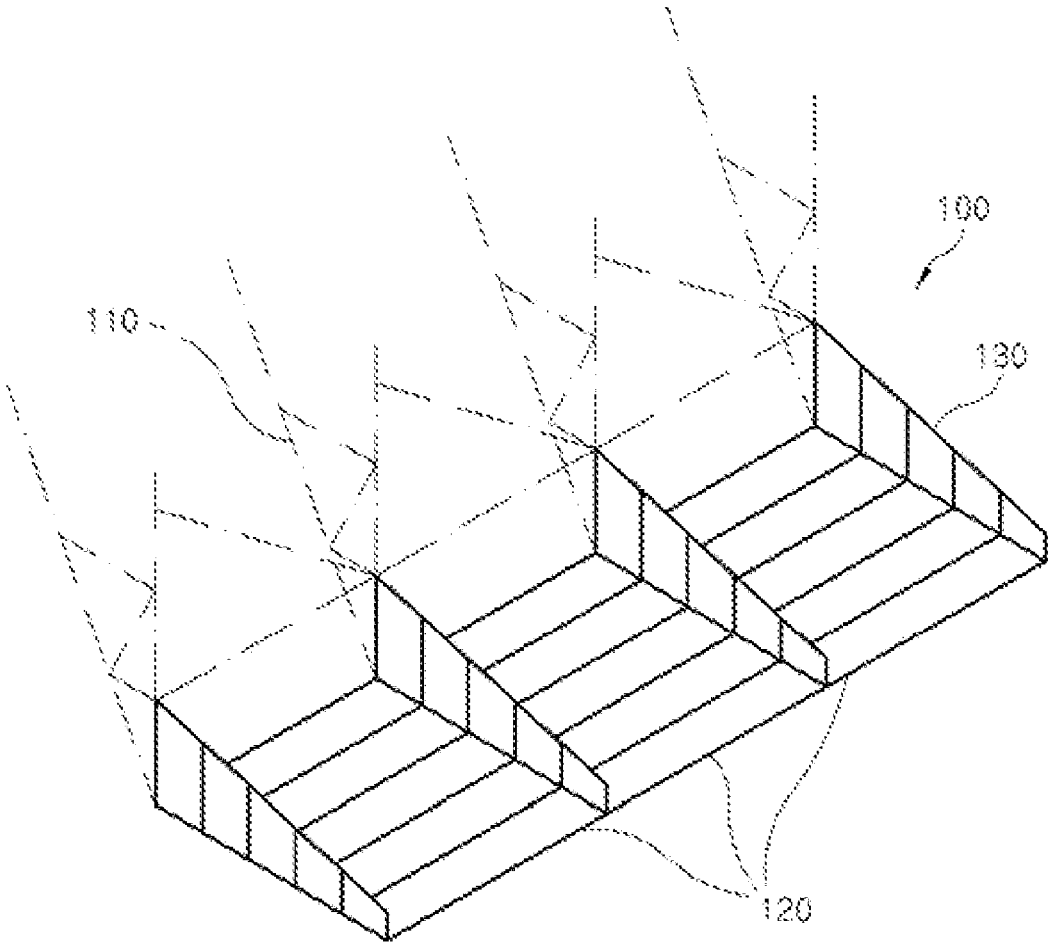
FIG. 3 is an enlarged perspective view of the roll-suppression device in accordance with the exemplary embodiment of the present disclosure.

FIG. 1 is a front view of a roll-suppression device for an offshore structure in accordance with one exemplary embodiment of the present disclosure, and FIG. 2 is a side view of the roll-suppression device in accordance with the exemplary embodiment of the present disclosure. Referring to FIGS. 1 and 2, a roll-suppression device 100 for an offshore structure 10 according to this embodiment includes a connection unit 110 under the bottom of the offshore structure 10, and a damping plate 120 connected to the connection unit 110 to suppress rolling. Herein, the offshore structure 10 includes a structure equipped with a plant or the like that produces/supplies crude oil or natural gas while at sea, for example, floating production storage offloading (FPSO), liquefied natural gas floating production storage offloading (LNG FPSO), floating storage and re-gasification unit (FSRU), etc. Additionally, the offshore structure 10 may also include a passenger ship, a cargo ship, and other ships for various purposes.

The connection unit 110 is disposed under the bottom of the offshore structure 10 and protrudes downward therefrom. In this embodiment, the offshore structure 10 is provided at opposite sides of the bottom thereof with connection units 110, which may have a truss structure or similar structure.

The damping plate 120 is connected to a lower end of the connection unit 110 and is separated downward from the bottom of the offshore structure 10 to suppress rolling. Further, in this embodiment, a pair of damping plates 120 is provided to efficiently suppress the rolling of the offshore structure 10 and connects with the corresponding connection units 110, which are respectively provided at the opposite sides of the bottom of the offshore structure 10, so as to be arranged along the opposite sides of the bottom of the offshore structure 10.

The damping plate 120 may have various dimensions depending on the size of the offshore structure 10. For example, the damping plate 120 is constituted by a large flat plate of 5 m or more in width, thereby noticeably increasing a roll-damping coefficient and providing a high effect of reducing rolling. Further, the connection unit 110 allows the damping plate 120 to be submerged 6 m or more below the hull baseline of the off shore structure 10, thereby overcoming restrictions of a conventional bilge-keel, step or the like.

Thus, the risk of direct collision with a ship can be removed during shuttle docking or ship-to-ship operation. The damping plate 120 may be disposed to face the outside of the offshore structure 10 while intersecting the lower end of the connection unit 110 at a right angle. Thus, the damping plate 120 can reduce rolling on the basis of energy loss due to drag resulting from pressure difference between a top surface and a bottom surface of the damping plate 120, its own superficial friction, and flow separation at an end thereof.

The roll-suppression device 100 for the offshore structure according to the embodiment further includes a reinforcement member 130 for structural reinforcement of the damping plate 120 or the like. The reinforcement member 130 has a structure of a plate, a frame or a bracket, and is connected to the damping plate 120 and the connection unit 110. Further, a plurality of reinforcement members 130 are successively arranged at regular intervals along one side of the damping plate 120, so that not only the damping plate 120 and the connection unit 110 are connected to each other through the reinforcement member 130 but also coupling force between the damping plate 120 and the connection unit 110 is improved, thereby preventing the damping plate 120 from being deformed or broken by external force.

The roll-suppression device 100 for the offshore structure according to the embodiment permit changes in size of the damping plate 120 and in size of the reinforcement member 130 and a support point depending on applications of the offshore structure 10 or an environmental load of the applied area. Here, the damping plate 120 and the like are manufactured as members properly divided in the longitudinal direction, carried to an operating site, and then connected to the hull of the offshore structure 10 through bolting. Thus, this connection allows a detachable design of the damping plate 10 to the hull of the offshore structure 10, thereby facilitating ship construction or shore operation inside a dock.

Operation of the roll-suppression device for the offshore structure according to the embodiment will be described hereinafter.

The damping plate 120 is separated downward from the bottom of the offshore structure 10 by the connection unit 110 and thus suppresses rolling of the offshore structure 10. Accordingly, it is possible to enlarge the span and width of the damping plate 120, thereby improving the efficiency with which rolling is suppressed.

For example, the damping plate 120 may have a width of 5 m or more, so that the roll-damping coefficient can be noticeably increased. Further, the damping plate 120 is placed downward by 6 m or more below the hull baseline of the offshore, so that the restrictions of a conventional bilge-keel, step or the like can be overcome, thereby fully eliminating the occurrence of direct collision with other ships during shuttle docking or ship-to-ship operation.

Further, the roll-suppression device 100 for the offshore structure 10 according to the embodiment is detachably coupled to the hull of the offshore structure 10, thereby facilitating ship construction or shore operation inside a drydock.

As such, the roll-suppression device for an offshore structure according to the embodiment permits enlargement of the width of the damping plate for suppressing roll of the offshore structure, thereby efficiently suppressing rolling, improving stability and work efficiency of the offshore structure, and eliminating a risk of collision or the like during shuttle docking or ship-to-ship operation. Further, the device is detachably coupled to the hull of the offshore structure, thereby facilitating ship construction or shore operation inside a drydock.

The various embodiments described above can be combined to provide further embodiments. Aspects of the embodiments can be modified, if necessary, to employ concepts of the various patents, applications and publications to provide yet further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A floating roll-resistant offshore system comprising:

an offshore structure having a longitudinally elongated shape with an overall longitudinal length extending from one end of the offshore structure to an opposing end thereof, a bottom of the offshore structure defining a hull baseline at a lowest point thereof; and a roll-suppression device including a pair of connection units and a pair of damping plates, each connection unit fixedly connected to the bottom of the offshore structure and configured to extend downward under the bottom of the offshore structure so that a distal end of each connection unit is below the hull baseline, and each damping plate including a plurality of plate members aligned in a longitudinal direction and connected to the distal end of a respective one of the pair of connection units to suppress rolling of the offshore structure, each damping plate separated downward from the bottom of the offshore structure entirely below the hull baseline and extending outwardly with respect to a centerline of the offshore structure, and each of the connection units and the respective damping plates extending along at least a majority of the overall longitudinal length of the offshore structure.

2. The offshore system of claim 1 wherein the pair of damping plates connect to the pair of connection units at opposing sides of the offshore structure.

3. The offshore system of claim 2 wherein each of the damping plates connects to the distal end of the respective one of the pair of connection units at a right angle.

4. The offshore system of claim 1 wherein the roll-suppression device further includes at least one reinforcement member secured between each of the damping plates and the respective one of the connection units to reinforce the damping plate.

5. The offshore system of claim 1 wherein each of the damping plates is detachably connected to the respective one of the connection units.

6. A floating roll-resistant offshore system comprising:

a floating offshore structure having a hull including opposing sidewalls and a bottom that define a longitudinally elongated shape, and having an overall longitudinal length extending from one end of the floating offshore structure to an opposing end thereof; and a roll-suppression device including a first and a second connection unit coupled to the floating offshore structure proximate a respective one of the opposing sidewalls and a first and a second damping plate coupled to a respective one of the first and the second connection units, each of the first and the second connection units sized to extend along at least a majority of the overall longitudinal length of the floating offshore structure and project downward away from the bottom of the floating offshore structure, and each of the first and the second damping plates extending generally perpendicular to the longitudinal length of the floating offshore structure and being offset from the bottom of the floating offshore structure by the respective one of the first and the second connection units to suppress rolling of the floating offshore structure.

7. The offshore system of claim 6 wherein each of the first and the second connection units is a truss structure configured to space the respective one of the first and the second damping plates below the bottom of the offshore floating structure and connect to the respective one of the first and the second damping plates along a longitudinal length of the respective damping plate.

8. The offshore system of claim 6 wherein each of the first and the second connection units is sized to space the respective one of the first and the second damping plates at least six meters below a hull baseline of the offshore floating structure defined by a lowest point of the bottom of the hull of the floating offshore structure.

9. The offshore system of claim 6 wherein each of the first and the second connection units is coupled to the respective one of the first and the second damping plates to form a rigid structure that extends along generally the entire overall longitudinal length of the floating offshore structure to suppress rolling of the floating offshore structure by interacting with a surrounding water environment in a region that also extends generally along the entire overall longitudinal length of the floating offshore structure.

10. The offshore system of claim 6 wherein each of the first and second damping plates include a plurality of plate members aligned in a longitudinal direction.

11. A roll-resistant floating offshore structure comprising:

a floating offshore structure including a hull having a bottom, the bottom of the hull of the floating offshore structure defining a hull baseline with respect to a lowest point thereof, and the floating offshore structure having an overall longitudinal length extending from one end of the floating offshore structure to an opposing end thereof; and a roll-suppression device including a first connection unit and a second connection unit each coupled to the floating offshore structure to extend along at least a majority of the overall longitudinal length of the floating offshore structure and to project downward away from the bottom of the hull of the floating offshore structure, and further including a first damping plate and a second damping plate connected to a respective one of the first and the second connection units, each of the first and the second damping plates extending generally perpendicular to the overall longitudinal length of the floating offshore structure and being offset from the bottom of the hull of the floating offshore structure entirely below the hull baseline by the respective one of the first and the second connection units to suppress rolling of the floating offshore structure.

* * * * *